US007174602B1

(12) United States Patent
Foral

(10) Patent No.: US 7,174,602 B1
(45) Date of Patent: Feb. 13, 2007

(54) VACUUM TRASH INSERTION RECEPTACLE

(76) Inventor: Elizabeth Foral, 1204 Colonial Cir., Papillion, NE (US) 68046

( * ) Notice: Subject to any disclaimer, the term of this patent is extended or adjusted under 35 U.S.C. 154(b) by 324 days.

(21) Appl. No.: 10/615,258

(22) Filed: Jul. 8, 2003

Related U.S. Application Data

(60) Provisional application No. 60/430,404, filed on Dec. 3, 2002, provisional application No. 60/395,502, filed on Jul. 12, 2002.

(51) Int. Cl.
*A47L 5/00* (2006.01)
*A47L 9/00* (2006.01)

(52) U.S. Cl. ..... 15/310; 15/319; 15/339

(58) Field of Classification Search ..... 15/310, 15/319, 339, DIG. 2, 347, 350–353; 100/49, 100/99, 345, 348; 220/908, 909
See application file for complete search history.

(56) References Cited

U.S. PATENT DOCUMENTS

| | | | | |
|---|---|---|---|---|
| 124,851 | A | 3/1872 | Penman | |
| 307,235 | A | 10/1884 | Slevin | |
| 816,989 | A | 4/1906 | Moler et al. | |
| 1,160,820 | A | 11/1915 | Bauer | |
| 1,482,144 | A | 1/1924 | Pender | |
| 2,177,328 | A | 10/1939 | Pender | 193/34 |
| D187,348 | S | 3/1960 | Goss | D58/25 |
| 3,066,345 | A * | 12/1962 | Kasper | 15/310 |
| D209,021 | S | 10/1967 | Fagenstrom | D58/17 |
| D222,842 | S | 1/1972 | Merck et al. | D7/5 |
| D222,921 | S | 2/1972 | Kingsley | D7/5 |
| D245,567 | S | 8/1977 | Burns | D7/194 |
| 4,443,235 | A * | 4/1984 | Brenholt et al. | 96/408 |
| 4,443,697 | A * | 4/1984 | Ryan et al. | 250/223 R |
| 4,519,307 | A * | 5/1985 | La Barge et al. | 100/99 |
| 4,805,255 | A * | 2/1989 | Hed | 15/314 |
| D322,345 | S | 12/1991 | Thompson | D34/4 |
| D322,346 | S | 12/1991 | Thompson | D34/4 |
| D325,109 | S | 3/1992 | Thompson | D34/4 |
| D327,757 | S | 7/1992 | Kouwenhoven | D34/4 |
| 5,205,013 | A * | 4/1993 | Lopes | 15/301 |
| 5,257,577 | A * | 11/1993 | Clark | 100/99 |
| D345,038 | S | 3/1994 | DeWeese | D34/1 |
| 5,329,212 | A * | 7/1994 | Feigleson | 318/16 |
| D350,000 | S | 8/1994 | Bird et al. | D34/4 |
| D356,000 | S | 3/1995 | Henrick et al. | D6/521 |
| D358,239 | S | 5/1995 | Abram | D34/1 |

(Continued)

FOREIGN PATENT DOCUMENTS

JP 6-197997 * 7/1994

(Continued)

*Primary Examiner*—Terrence R. Till
(74) *Attorney, Agent, or Firm*—Suiter Swantz PC LLO

(57) ABSTRACT

A vacuum trash insertion receptacle includes an aesthetically shaped housing providing a trash tube for the insertion and transportation of garbage to a trash receptacle assembly. A control assembly in communication with a gate monitoring assembly, an interactive module assembly, a vacuum assembly, and an indicator assembly, controls the functioning of the vacuum trash insertion receptacle. The gate monitoring assembly provides information on the presence of garbage being inserted. The vacuum assembly provides a vacuum to the trash tube. The interactive module assembly provides audio feedback to a user of the vacuum trash insertion receptacle. The indicator assembly provides information regarding the level of stored trash currently in the trash receptacle assembly.

16 Claims, 9 Drawing Sheets

U.S. PATENT DOCUMENTS 5,655,253 A * 8/1997 Nevin et al. ..... 15/310
5,695,114 A * 12/1997 Evans ..... 232/43.2
5,946,768 A * 9/1999 Kelly ..... 15/315
5,953,788 A * 9/1999 Douglas ..... 15/339
6,026,539 A * 2/2000 Mouw et al. ..... 15/339
6,058,560 A * 5/2000 Gab et al. ..... 15/339
6,088,864 A * 7/2000 Smith, II ..... 15/53.1
6,671,924 B1 * 1/2004 Rood ..... 15/310
2002/0108507 A1 * 8/2002 May et al. ..... 100/45
2002/0152577 A1 * 10/2002 Moore et al. ..... 15/339
2004/0093686 A1 * 5/2004 Freeman ..... 15/339
2004/0103493 A1 * 6/2004 Moore et al. ..... 15/339

FOREIGN PATENT DOCUMENTS

JP 2003-320348 * 11/2003

* cited by examiner

VACUUM TRASH INSERTION RECEPTACLE

CROSS REFERENCE TO RELATED APPLICATION

The present application claims priority under 35 U.S.C. 119(e) to the U.S. Provisional Application Ser. No. 60/395,502, filed on Jul. 12, 2002, and the U.S. Provisional Application Ser. No. 60/430,404 filed on Dec. 3, 2002. Both U.S. Provisional Application 60/395,502 and 60/430,404 are herein incorporated by reference in their entireties.

FIELD OF THE INVENTION

The present invention generally relates to the field garbage collection, and particularly to a vacuum trash insertion receptacle.

BACKGROUND OF THE INVENTION

Trash receptacles are well known in the prior art, many coming equipped with aesthetically appealing housings or casings. They are also used in a variety of forums, such as theme parks, amusement parks, theaters, and the like.

Unfortunately, most trash receptacles do not provide a system for ensuring that the trash placed in them gets down and stays down in the receptacle. Nor do they provide maintenance workers with an indication of when they are full. Many trash receptacles also fail to properly communicate with users, which, if corrected, would aid the effort to improve the receptacles' performance. These concerns become problematic, for instance, when the trash is not properly inserted into the receptacle and becomes dispersed by wind, rain, or other elements outside of the trash receptacle. Such direct exposure to trash is a health hazard to the users of the receptacle and those responsible for its maintenance. Further, if the trash receptacle is allowed to overfill, odor problems may result and the receptacle may become a breeding ground for insects. Additionally, some receptacles may be so aesthetically appealing that they may not be recognized for trash receptacles, which results in decreased utilization. This may be particularly problematic to theme parks attempting to maintain their appearance without distressing their guests.

Therefore, it would be desirable to provide a trash receptacle that is both visually appealing and provides for the safe and effective gathering and storage of trash.

SUMMARY OF THE INVENTION

Accordingly, the present invention is directed to a vacuum trash insertion receptacle (hereinafter "VTIR"). The VTIR provides effective trash collection and storage. In a first aspect of the present invention, the VTIR includes a housing coupled with a vacuum assembly. The vacuum assembly further couples with a refuse receptacle assembly. The vacuum assembly is suitable for accepting refuse from the outside environment and delivering it for storage in the refuse receptacle. The VTIR further includes an indicator assembly coupled to the refuse receptacle assembly that indicates the level of refuse within the refuse receptacle assembly. Additionally, the VTIR includes an audio interactive module coupled to the housing, which provides interaction with a user of the VTIR.

In a second aspect of the current invention, the VTIR includes an animal aesthetic assembly for providing a visually identifiable refuse collection system. A vacuum assembly is coupled with the animal aesthetic assembly, the vacuum assembly being suitable for accepting refuse. A refuse storage assembly is coupled with the vacuum assembly for storing refuse, and an indicator assembly indicates the level of refuse within the refuse storage assembly. Further, an audio/video interactive module provides interaction with a user and passersby.

In a third aspect of the current invention, a portable VTIR comprising a vacuum assembly coupled with a portable housing assembly is provided. The vacuum assembly being suitable for accepting refuse into a refuse storage assembly coupled with the vacuum assembly. The portable VTIR being suitable for retro-fitting into a variety of housing.

In a fourth aspect of the current invention, a method for the collection of garbage includes the steps of establishing a VTIR, identifying a user in need of garbage collection, and accepting the garbage. The present method may further help to avoid confusion over the utility of a VTIR by a potential user by clearly indicating its function and providing an interactive methodology for obtaining the garbage from the user.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1:
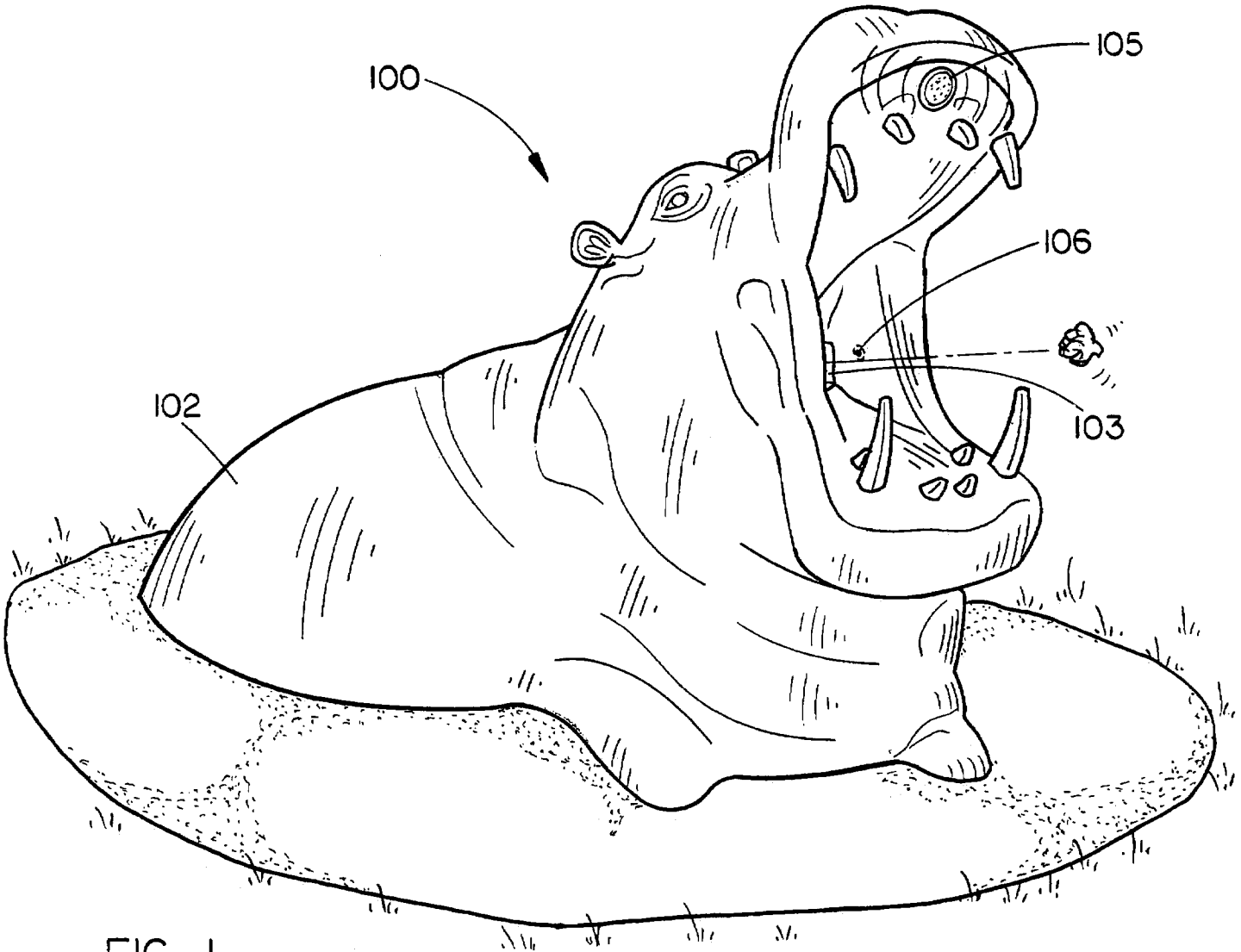
FIG. 1 is an illustration of a vacuum trash insertion receptacle in accordance with an exemplary embodiment of the present invention.

Reference will now be made in detail to the presently preferred embodiments of the invention, examples of which are illustrated in the accompanying drawings.

Referring generally now to FIGS. 1 through 4, exemplary embodiments of the present invention are shown. A VTIR provides an aesthetically appealing medium within which trash may be collected. This may be important to a variety of business enterprises that wish to maintain particular standards of appearance within the venues they provide. For example, a zoo may be interested in the hippopotamus version of the present invention while an amusement park may be interested in the VTIR with an outward appearance of a cartoon character. The use of the VTIR may help ensure that trash is placed in a trash receptacle instead of being left on the surface of the housing. This may significantly decrease the unsightly appearance of trash on the ground immediately surrounding the VTIR. Further, by removing trash to a receptacle remotely located to the trash insertion area, the risks of noxious odors being emitted and health hazards being created for users and passersby may be decreased.

A VTIR 100 is shown in FIGS. 1, 2, 3, and 4. Preferably, the VTIR 100 includes a housing 102 disposed with a gate 103 and a gate monitoring assembly including a first sensor 104 and a second sensor 106. An access panel 108 is disposed on the housing 102 to allow internal access by a user. The gate 103 is a first end of a trash tube 122, the trash tube 122 being further discussed below, disposed within the housing 102. It is contemplated that the gate 103 may present as a movable door, a flap, and the like, also including a locking mechanism. Further, the first and second sensors 104 and 106 of the gate monitoring assembly may be coupled to the movable door or flap of the gate 103 or at the entrance of the trash tube 122.

In the present embodiment, an interactive module assembly comprising an audio module 105 is coupled to the housing 102 of the VTIR 100. The audio module 105 provides speech interaction with guests and users of the VTIR 100. For example, upon insertion of trash into the VTIR 100 the audio module 105 may provide an audible "Thank you" response. Additionally, a speech recognition assembly may be coupled with the audio module 105 enabling the VTIR 100 to answer questions from users.

Figure 2:
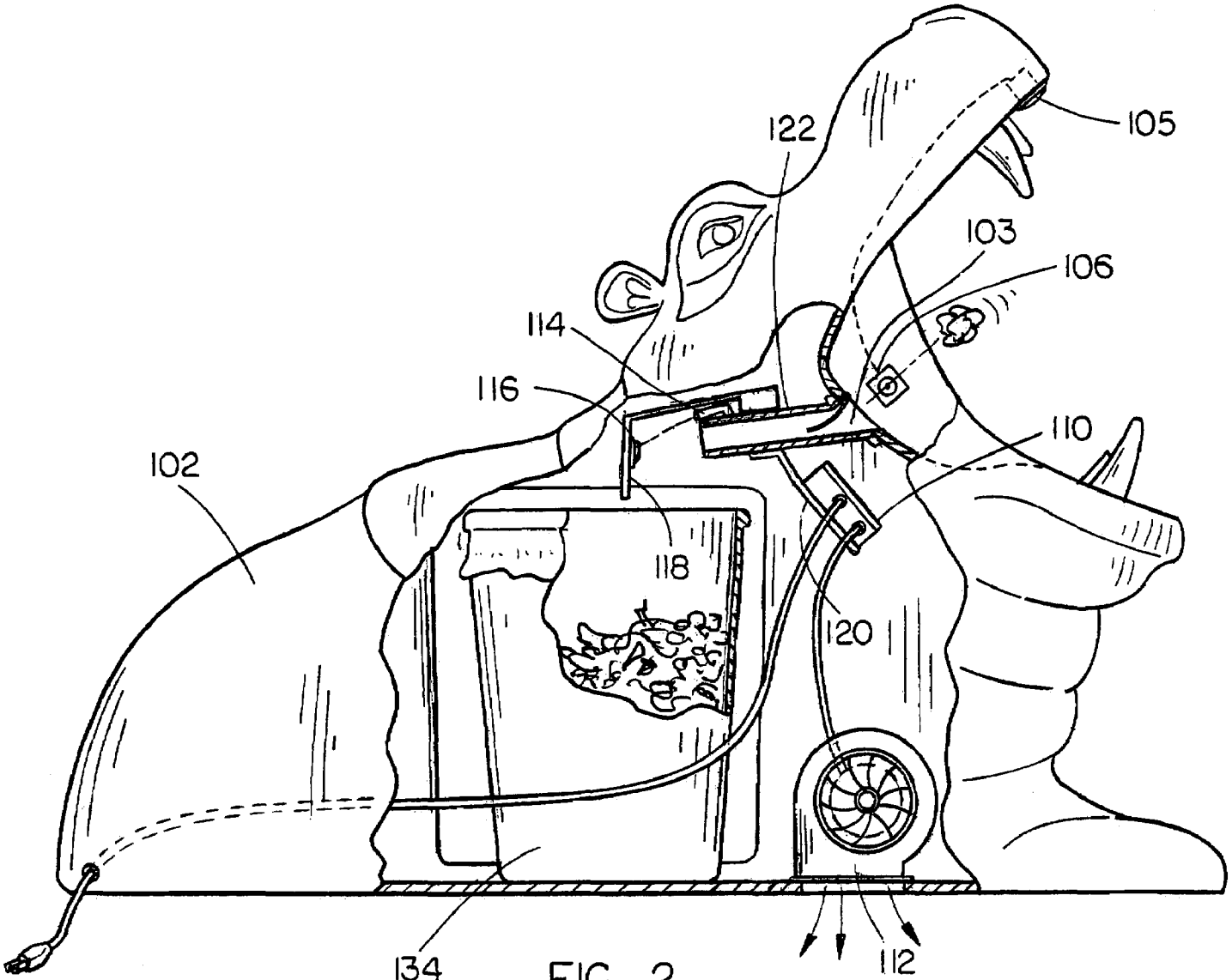
FIG. 2 is a cut-away illustration of the vacuum trash insertion receptacle.
Figure 3:
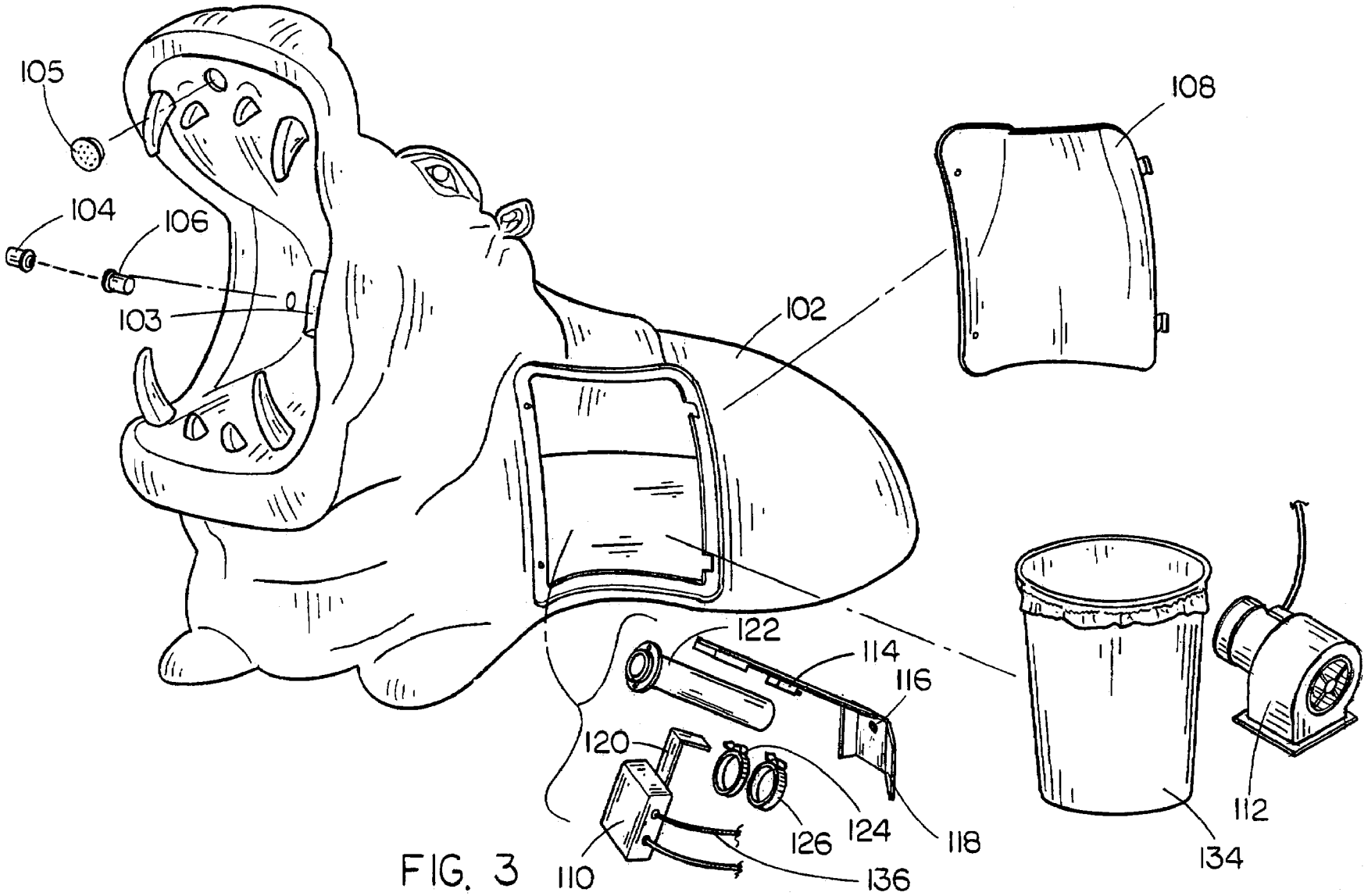
FIG. 3 is an exploded view of the vacuum trash insertion receptacle.

In the current embodiment, a control assembly 110 is coupled to a vacuum assembly 112, the first and second sensors 104 and 106, and an indicator assembly which comprises a trash level indicator 114 and an indicator reflector 116 mounted upon a trash dump backstop 118. Preferably, the trash level indicator 114 is mounted to the trash tube 122. The trash dump backstop 118 including the indicator reflector 116 is capable of coupling to the trash tube 122. As can be seen in FIG. 2 the trash dump backstop 118 includes an arm that connects to the trash tube 122 and extends the trash dump backstop 118 away from the end of the trash tube 122. The arm is also positioned at an angle relative to the trash tube so that the backstop 118 hangs slightly inside the trash receptacle 134. The control assembly 110 is further coupled to a mounting assembly 120 which enables the control assembly 110 to be coupled to the trash tube 122. In the present embodiment, the mounting assembly 120 and the trash dump backstop 118 are coupled to the trash tube 122 by use of a first O-ring clamp 124 and a second O-ring clamp 126.

Preferably, the control assembly 110 may be enabled as a computing system. Coupling of the control assembly 110 with the vacuum assembly 112, gate monitoring assembly, and the trash indicator assembly establishes communication links between and among the working parts of the VTIR 100. As will be discussed in FIGS. 5 and 6, the control assembly also couples with other additional features of the VTIR, such as animated features and interactive features. The control assembly 110 processes information received through the communication links and sends commands to the appropriate functional assembly/feature for activation.

The computing system of the control assembly 110 may include a variety of technologies as contemplated by one of ordinary skill in the art. For example, the communication links may be through use of serial cables, universal serial bus cables, parallel port cables, and the like. Alternatively, the communication links may be enabled through wireless technology, such as radio frequencies, infrared, Bluetooth, and the like.

The control assembly 110 is further coupled with the gate monitoring assembly including the first and second sensors 104 and 106. The first and second sensors 104 and 106 provide a sensing field. A drainage hole or conformed area may be included in the housing 102 where the sensors 104 and 106 are located to prevent a build-up of residue from hindering the sensors' performance. The sensing field may be a laser beam, radio wave, and the like, that spans the area of the gate 103. The gate monitoring assembly provides information to the control assembly 110 that tells the control assembly 110 to turn on and off the vacuum assembly 112. For example, when trash is inserted through the gate 103, the first and second sensors 104 and 106 signal the control assembly 110 to turn on the vacuum assembly 112.

The vacuum assembly 112, in the present embodiment, includes a fan driven by a motor. The fan is positioned inside the housing 102. The fan's outlet is connected to a vent in the housing 102 where exhaust air departs. When the fan is operating, a vacuum is created inside the housing 102 that provides suction at the gate 103. Then, a flap or door swings open at the gate 103 to accept the trash. In the present embodiment, the vacuum assembly 112 is regulated by the control assembly 110. The vacuum assembly 112 may also be controlled by a timer or a switch. It is understood that other configurations of the vacuum assembly 112 and a variety of vacuum creating devices may be employed as contemplated by one of ordinary skill in the art without departing from the scope and spirit of the present invention.

The trash tube 122 may be composed of metal, plastic, or the like. The trash tube 122 may include a non-stick surface on the inner wall and may be coupled with a cleaning system. The cleaning system may provide flushing capabilities to wash out the trash tube 122 with fluid and it may provide chemical treatment capabilities to break down residue that may build up on the inner wall of the trash tube 122.

Figure 4:
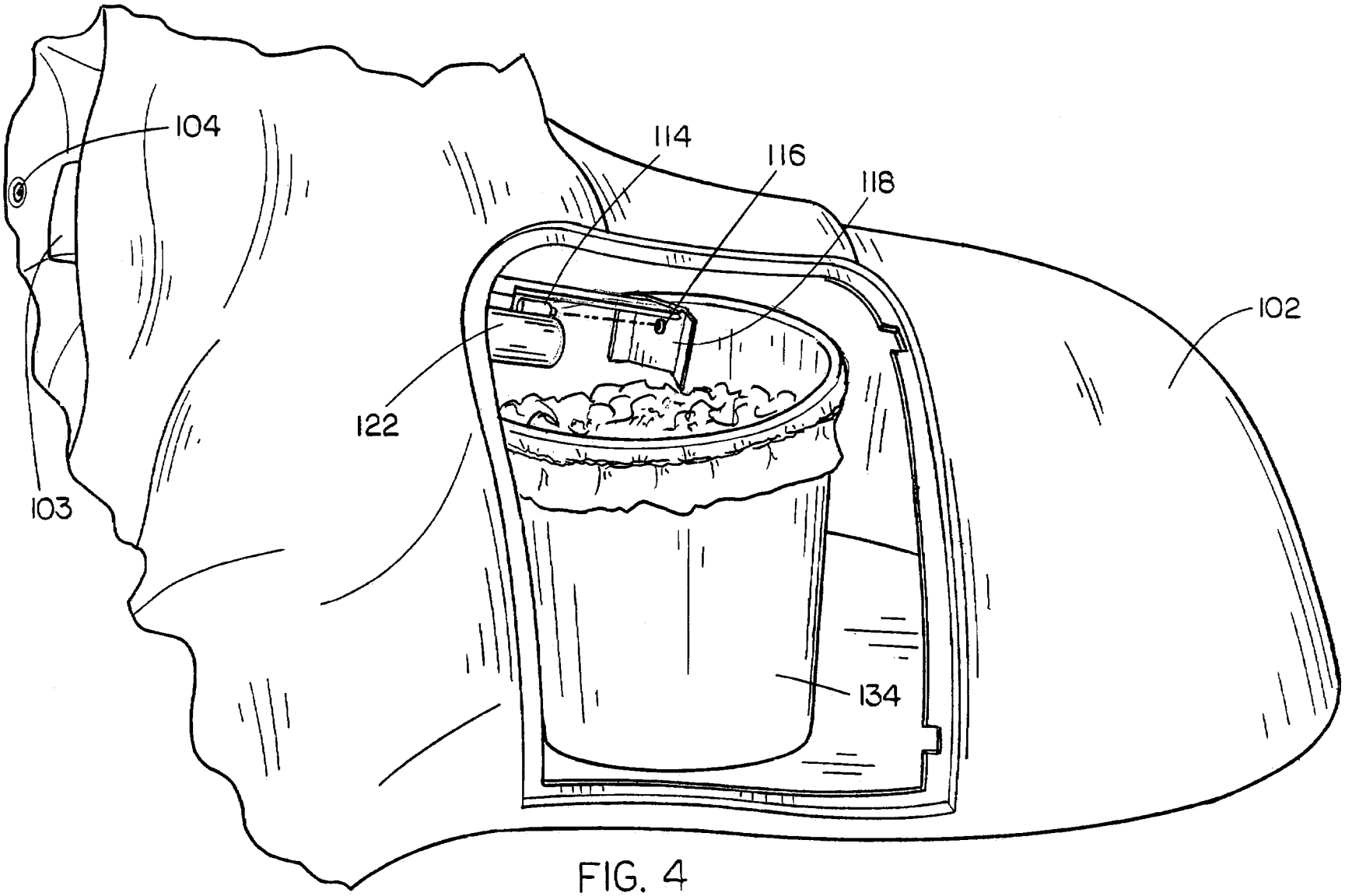
FIG. 4 is a side-view illustration of the vacuum trash insertion receptacle with an access panel removed.

The trash tube 122, including the trash indicator assembly, couples with a trash receptacle assembly 134. In the preferred embodiment, the trash tube 122 operationally engages with the trash receptacle assembly 134 on a horizontal plane established by the trash receptacle assembly 134. It is contemplated that the trash tube angle may vary. For instance, the angle between the trash tube 122 and the horizontal plane established by the receptacle assembly 134 may be between 0 and 10 degrees. This angle allows the trash to move easily to the receptacle assembly 134 and at the same time prevents trash already inside the receptacle assembly 134 from blocking the trash tube 122. The trash receptacle assembly 134 is situated to gather trash inserted into the trash tube 122 and remain accessible to users of the VTIR 100 through access panel 108 as shown in FIG. 4.

In alternative embodiments the trash tube 122 may connect directly with the trash receptacle assembly 134. This direct connection may occur through the use of a hood that fits over the trash receptacle assembly 134 and couples with the trash tube 122. The hood may reduce spillage and assist in odor control within the housing 102. Further, the hood may decrease the build up of insects around the trash receptacle assembly 134 and reduce possible health hazards by isolating the trash from the housing 102. In still another embodiment a permanent backstop may be coupled to the interior of the housing 102 immediately behind the location where the trash receptacle assembly 134 is situated. The permanent backstop may further include an indicator reflector such as that coupled to the backstop 118, to provide trash build up information. In yet another embodiment the trash tube 122 may operationally engage with a large underground trash storage area. For example, some amusement parks employ an underground system of dumpsters for collecting their garbage. Each dumpster in such a system could except trash from one of several VTIR 100*s* by way of the trash tube 122. This would benefit the park or zoo in its effort to provide an aesthetic method of collecting and storing trash because patrons would never see maintenance workers unloading the VTIR 100*s* placed throughout the park or zoo.

In the current embodiment, power is provided through a power cord 136, commonly referred to as a "pigtail" in the art, coupling with a power outlet that is remote to the VTIR 100. The power cord 136 is positioned to navigate through the housing 102 and then outside to a remote AC power outlet. In an alternative embodiment, the control assembly 110 and vacuum assembly 112 may be coupled with an AC power outlet mounted inside the housing 102. It is contemplated that a variety of modular and interchangeable power sources may be coupled with the control assembly 110 and the vacuum assembly 112. Further, the modular power source may be a rechargeable power source or also fuel cells.

Preferably, the trash receptacle assembly 134 comprises a standard trashcan. The exact dimensions of the trashcan may vary by the design of the housing 102 and the needs of the consumer. Alternatively, the trash receptacle assembly 134 may include a trash compacting assembly. The trash compacting assembly may be coupled with the trash tube 122 and the trash receptacle assembly 134. Such a trash compacting assembly may be remotely located to the trash receptacle assembly 134, but the coupling of the trash compacting assembly to the trash receptacle assembly 134 ensures that the compacted trash is delivered to the trash receptacle assembly 134.

The housing 102 may take on a variety of forms, such as an animal, cartoon character, celebrity, or the like. The design of the housing 102 may be critical to the consumer and it is understood that the VTIR 100 may have its design tailored to meet the specific needs of a consumer. The location of the gate 103 may be varied, for instance, the gate may be placed in the body of the animal leaving the mouth free to be used for other purposes. The location of the access panel 108 may be shifted to accommodate different presentation positions, for instance, one VTIR 100 may be shaped like an animal lying down while another may be shaped like an animal running, standing on its hind legs, crouching, or the like. The housing 102 may also be equipped with a movable base assembly so that it can be repositioned with ease.

Additionally, the VTIR 100 may include an insect control assembly. The insect control assembly may help to reduce the number of insects that aggregate in and around the VTIR 100, which may reduce the risk of creating health hazards. Further, the aesthetic appeal of the VTIR 100 is maintained by decreasing the insect population around it. Another feature that may be added to the VTIR 100 is a water enhancement assembly. The water enhancement assembly may include such features as a water fountain, a water basin, and the like. For example, the VTIR 100 may include a water display that shoots water into the air. Alternatively, the water enhancement assembly may maintain standing water in and around the VTIR 100. Further, the water enhancement assembly may provide a drinking fountain in proximity to the VTIR 100.

A smoke detection assembly may also be included within the VTIR 100. As trash compacts in the enclosed space of the VTIR 100 it may start to build up heat. If left unchecked for a period of time, the heat build up may ignite the trash. In the process of heat build up, before ignition of the trash, smoke may be produced. Therefore, a smoke detection assembly located in close proximity to the trash receptacle assembly 134 may prevent the VTIR 100 from igniting into flames. Not only would this protect the VTIR 100 but it may also protect users and passersby from injury, such as burns and smoke inhalation.

Figure 5:
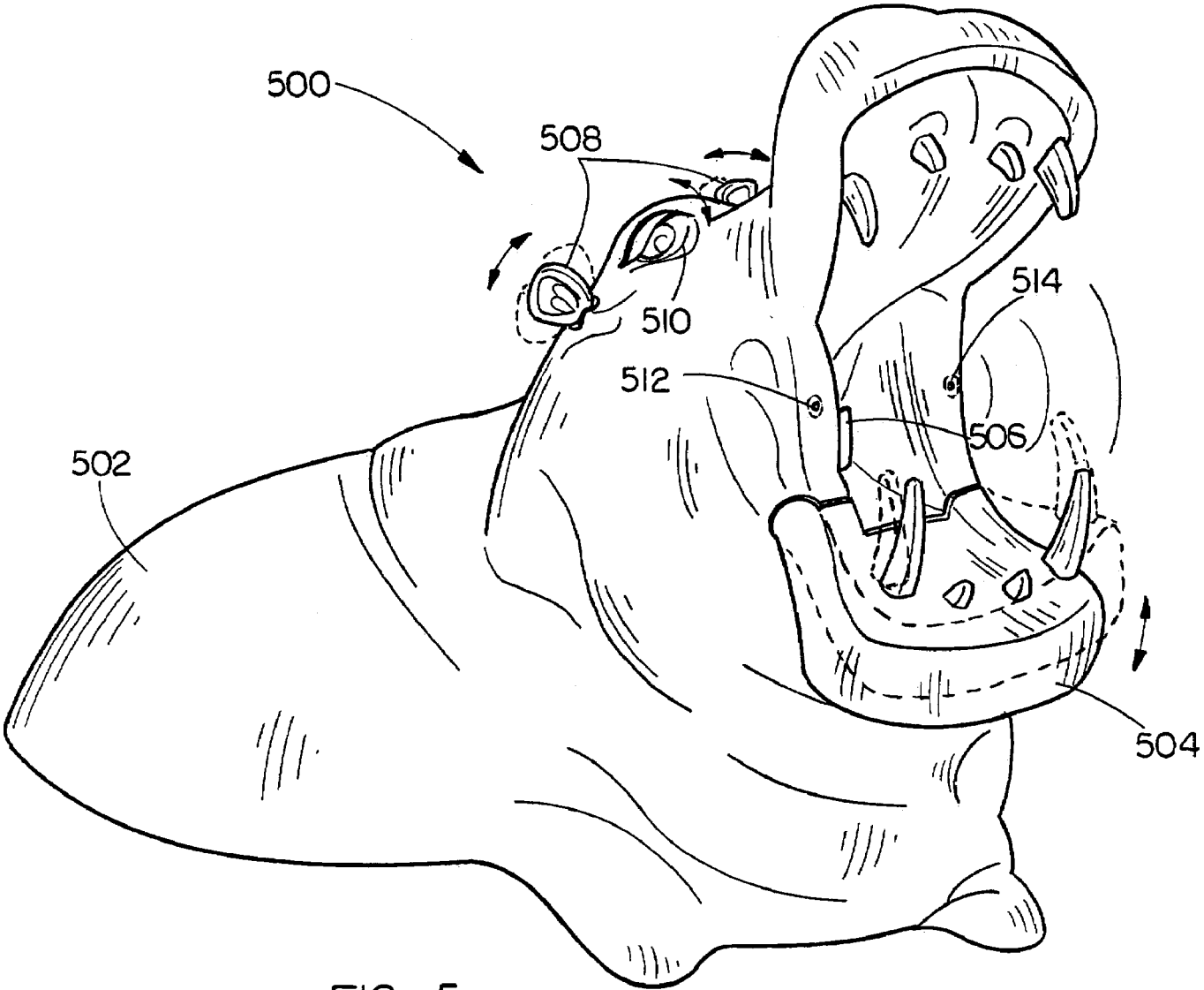
FIG. 5 is an illustration of an animation vacuum trash insertion receptacle in accordance with an exemplary embodiment of the present invention.

Referring now to FIG. 5, an animation VTIR 500 is shown. In the preferred embodiment, the animation VTIR 500 includes a housing 502 disposed with an animation assembly, such as an animated lower jaw assembly 504. The animated lower jaw assembly 504 may simulate a closing mouth of the animation VTIR 500 when trash is inserted into the trash tube 506. Further, the housing 502 may be disposed with an animated ear assembly 508. The animated ear assembly 508 may simulate wiggling ears on the animation VTIR 500 when trash is inserted into the trash tube 506. Additionally, the housing 502 may be disposed with an animated eye assembly 510 which may simulate eye movements, such as moving pupils and closing eyelids when trash is inserted in the trash tube 506.

A trash insertion sensing assembly includes a first sensor 512 and a second sensor 514. The first and second sensors provide the animation VTIR 500 with an indication of when trash is being inserted into the trash tube 506. From this indication information, the animation VTIR 500 may initiate movement of the animated features. It is contemplated that a proximity sensing assembly may be included on the animation VTIR 500. The proximity sensing assembly may provide distance information to the animation VTIR 500 and be tied to the initiation of the animated features. For example, the animation VTIR 500 may require a particular minimum distance be established before the animated movements will be initiated.

In alternate embodiments of the present invention a variety of animated features may be employed. For example, the animation VTIR 500 may be given legs and the legs may be enabled as animated features. Further, the animation VTIR 500 may be another animal, such as a monkey with arms that may be enabled as animated features. Additionally, the eyes of an animal may light up and sounds that the animal makes may be included as part of the animation. While the current embodiments and description encompass several animated features and other animated possibilities, it is understood that they are not intended as an exclusive listing or limiting range but instead as exemplary. It is understood that other animated features as contemplated by one of ordinary skill in the art may be employed without departing from the scope and spirit of the present invention.

Figure 6:
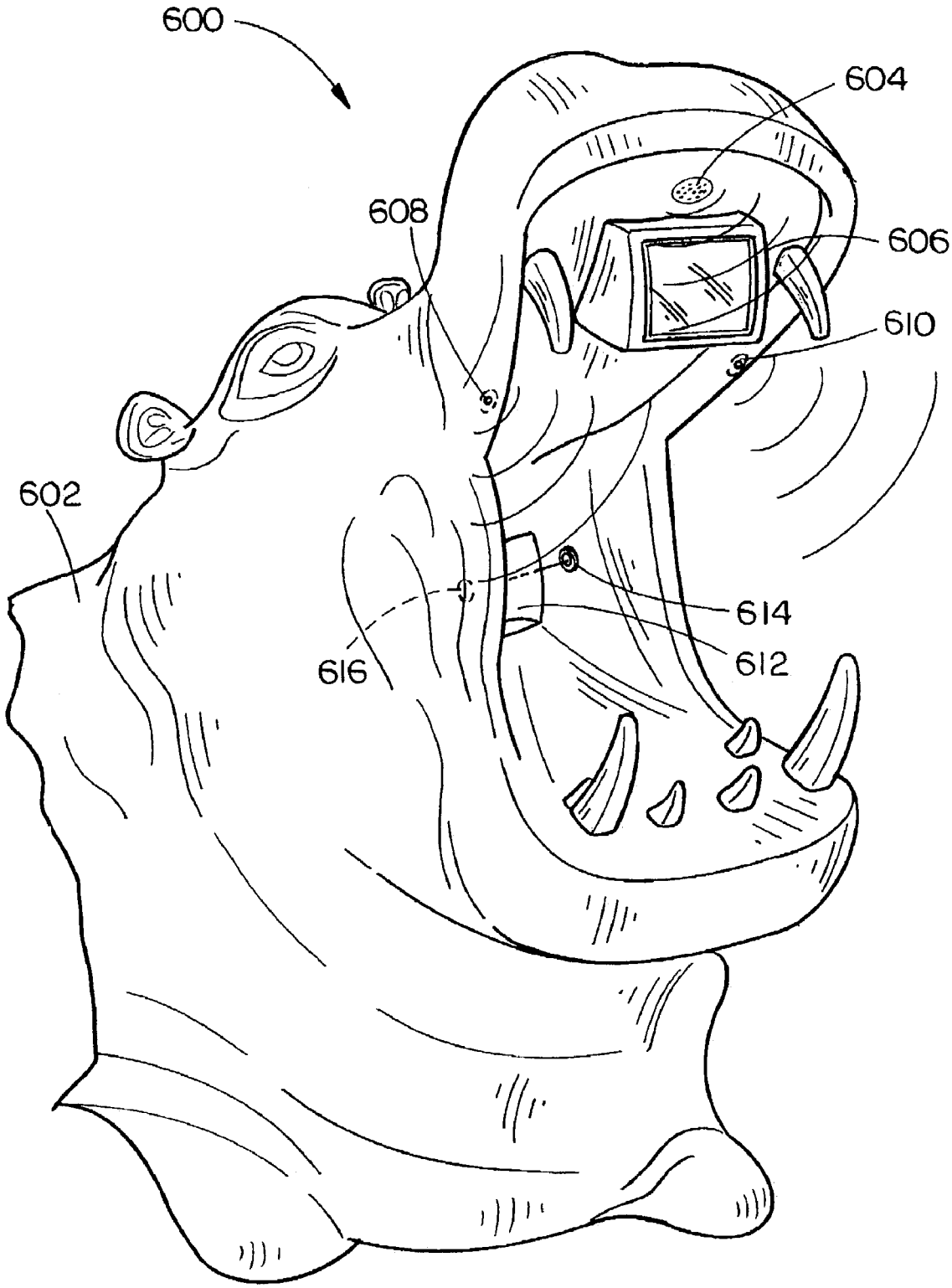
FIG. 6 is an illustration of an interactive vacuum trash insertion receptacle in accordance with an exemplary embodiment of the present invention.

FIG. 6 shows an audio/video interactive VTIR 600. The audio/video interactive VTIR 600 comprises a housing 602 disposed with an audio module 604, a video module 606, and a proximity assembly comprising a first proximity sensor 608 and a second proximity sensor 610. A trash tube 612, a first sensor 616, and a second sensor 614, for monitoring and accepting the insertion of trash are similar to those described in previous embodiments and are shown included within housing 602.

The audio module 604, as discussed in FIGS. 1 through 6, provides speech interaction with guests and users of the audio/video interactive VTIR 600. For example, upon insertion of trash into the audio/video interactive VTIR 600 the audio module may provide an audible "Thank you" response. The video module 606 provides visual interaction with guests and users of the audio/video interactive VTIR 600. For example, upon insertion of trash into the audio/video interactive VTIR 600 the video module 606 may show an image expressing thanks for the use of the audio/video interactive VTIR 600.

The audio module 604 and the video module 606 may be further enabled to provide a variety of interactive features. For instance, a speech recognition assembly may be tied to either or both of the audio module 604 or the video module 606 giving the audio/video interactive VTIR 600 the ability to answer questions. For example, a user may ask the audio/video interactive VTIR 600 where a particular site/attraction is located and the audio module 604 may give audible directions or the video module 606 may provide the image of a map and indicate the location of the desired site/attraction.

Additionally, the video module 606 may include features such as a touch screen display allowing users to independently search for information. The touch screen display may be protected by some sort of barrier, such as a shield, but still allow a user to interact with the display.

It is understood that the audio/video interactive VTIR 600 may include either the audio module 604 or the video module 606 or both modules. Further, either or both of the modules may be incorporated into the animated VTIR 500 described in FIG. 5. Further, either or both module may be coupled with the animation assembly of FIG. 5 in order to directly link animation movements to interaction with the user.

The proximity assembly utilizing the first and second proximity sensors 608 and 610 enables the audio/video interactive VTIR 600 to determine when a user is in the area. The sensors may be enabled with a particular range of distance immediately surrounding the audio/video interactive VTIR 600 to provide information to the proximity assembly. The range of distance may be an adjustable feature.

The proximity assembly may be coupled to the audio module 604 and the video module 606. With the audio/video interactive VTIR 600 so enabled, interaction with guests and users may be increased. Instead of only responding to having trash inserted the audio/video interactive VTIR 600 may invite interaction with passersby. This may be useful in a theme park or zoo with multiple sites and attractions spread across a large area. A passerby may not have trash but instead want to know the location of a particular ride. If the passerby comes within range of the proximity sensors 608 and 610, the proximity assembly may initiate the audio module to query, "May I help you today?" The passerby has now been informed that information is available to them through the audio/video interactive VTIR 600 whereas without the proximity alert and concomitant query the passerby may have not used the audio/video interactive VTIR 600 helpful features. The passerby may ask the question and be provided with useful information concerning the location of the ride they desire. It is understood that the nature of the statements made and the information provided by the audio/video interactive VTIR 600 may vary as directed by one of ordinary skill in the art. It is further contemplated that the consumer of the audio/video interactive VTIR 600 may be provided with the ability to create individualized interactive speech patterns and video displays.

Figure 7:
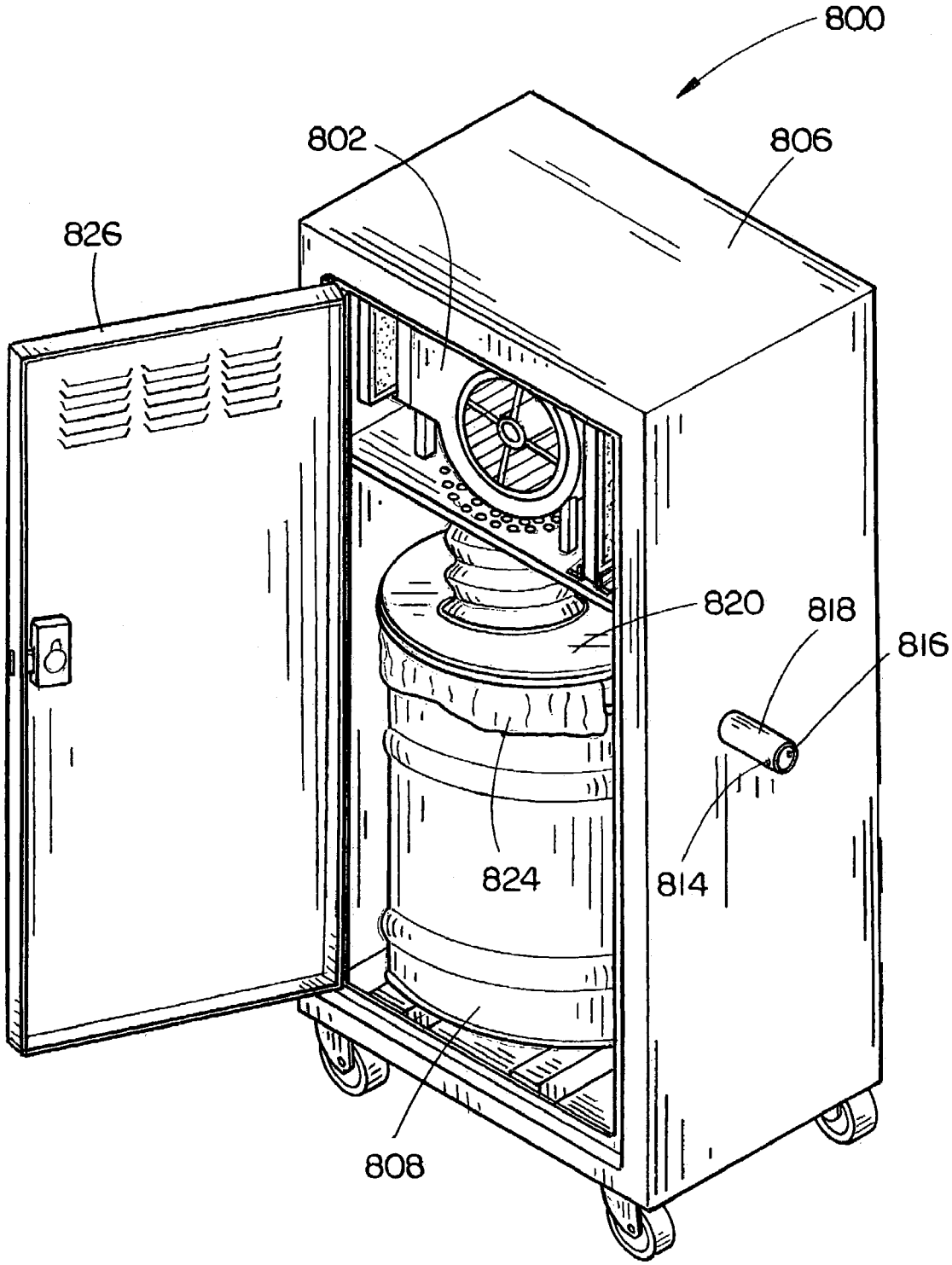
FIG. 7 is an illustration of a portable vacuum trash insertion receptacle.
Figure 8:
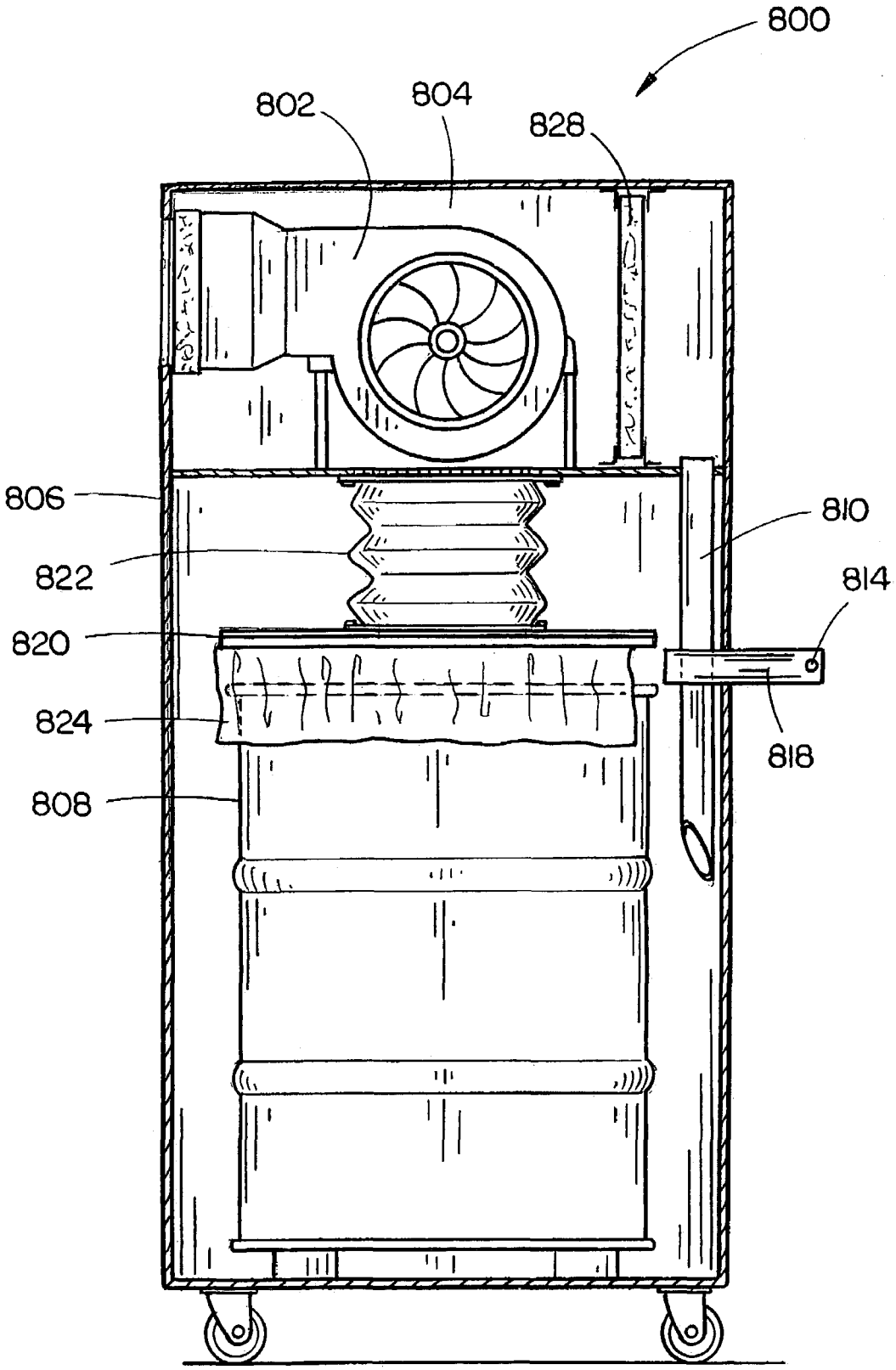
FIG. 8 is a cut-away illustration of the portable vacuum trash insertion receptacle.

Referring now to FIG. 7 and FIG. 8, an alternative embodiment of the present invention is shown. In the present embodiment, a portable VTIR 800 includes a vacuum assembly 802 which is enclosed in a casing 804 inside a portable housing 806. A trash receptacle 808 is located in the portable housing 806 separated from the casing 804. An air tube 810 allows air to travel into the casing 804 from the rest of the portable housing 806 when the vacuum assembly 802 is operating. A filter 828 is disposed proximally between the air tube 810 and the vacuum assembly 802 to clean the air before it is pulled through the vacuum assembly 802. The vacuum assembly 802 is regulated by a control assembly and sensors 814 and 816, which are disposed proximally to the entryway of a trash tube 818. The vacuum assembly 802 may be supplied with power by an AC cord commonly referred to in the art as a "pigtail." It is also contemplated that the vacuum assembly 802 may be powered by a fuel cell, battery, or the like. In the preferred embodiment, the trash tube 818 operationally engages with the trash receptacle 808 on a horizontal plane established by the trash receptacle 808. It is contemplated that the trash tube angle may vary. For instance, the angle between the trash tube 818, and the horizontal plane established by the trash receptacle 808 may be between 0 and 10 degrees.

To reduce noxious odors, a trash receptacle lid assembly 820 remains closed unless trash is placed in the trash tube 818. The trash receptacle lid assembly 820 includes a beveled lift apparatus 822 that is flexible and retracts in an accordion-like manner when the vacuum assembly 802 is operating. Since the beveled lift apparatus 822 is coupled with the casing 804, the vacuum assembly 802 creates an area of low pressure inside the beveled lift apparatus 822, which allows for its retraction. The vacuum assembly 802 also creates an area of low pressure inside the housing 804, which allows for the trash to be sucked through the trash tube 818 and, eventually, the trash receptacle 808. To prevent the trash from missing the trash receptacle 808, a deflector flap 824 hangs from the trash receptacle lid assembly 820 on the opposite side from the trash tube 818. The deflector flap 824 rests inside the trash receptacle 808 when the trash receptacle lid assembly 820 is in the closed position.

To further explain how the portable VTIR 800 operates, first trash is placed in the trash tube 818 where sensors 814 and 816 trigger the vacuum assembly 802 to begin operating inside the casing 804. This creates a vacuum in the portable housing 806 that both lifts the trash receptacle lid assembly 820 from the trash receptacle 808 and sucks the trash through the trash tube 818. Next, the trash is projected into the portable housing 806 and ricochets off the deflector flap 824 into the trash receptacle 808. The portable housing 806 is also equipped with a door 826 that makes maintaining the portable VTIR 800 convenient. It is also contemplated that the present embodiment may be coupled with the housing 102, 502, or 602 of the VTIR 100, such that an amusement park or zoo could use the present embodiment in an aesthetically pleasing manner. To explain, maintenance employees of the zoo or amusement park could simply roll the portable VTIR 800 into the housing 102, 502, or 602, which would prepare the housing for accepting trash. The portable VTIR 800 could couple with the housing 102, 502, or 602 through a variety of means. For instance, it is contemplated that the trash tube 102 could couple directly with the trash tube 818 of the portable VTIR. It is also contemplated that the trash tube 818 could couple directly with the gate 103, preparing the housing 102, 502, or 602 for accepting trash.

Figure 9:
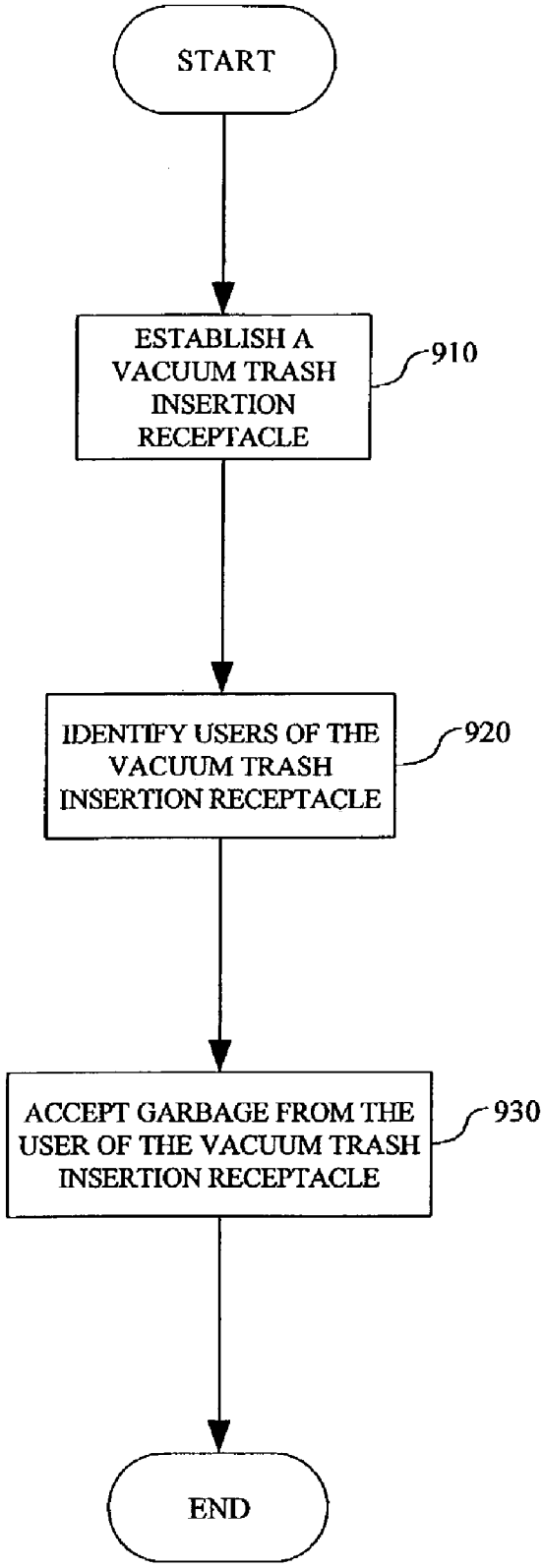
FIG. 9 is a flowchart illustrating a method of collecting garbage in accordance with an exemplary embodiment of the present invention.

Referring now to FIG. 9, a method of collecting garbage is shown. The first step 910 establishes a VTIR similar to those described in the previous FIGS. 1 through 8. In step 920 a VTIR similar to that shown in FIGS. 1 through 8, identifies a user in need of garbage collection. Identification may occur through use of the gate monitoring assembly. The gate monitoring assembly is coupled to the control assembly and activation of the gate monitoring assembly instructs the control assembly that trash is being inserted into the VTIR.

Alternatively, identification may occur through the use of a proximity assembly similar to that discussed in FIG. 6. The proximity assembly may be coupled with an interactive module assembly similar to that shown and described in FIG. 6. The interactive module assembly may include the audio module and/or the video module. Using the interactive module assembly, the VTIR may initiate interaction. For example, the proximity assembly may determine that a passerby, a possible user, is within a certain distance and activate the audio module, which may query the passerby, "Are you looking to get rid of your garbage?" It is understood that the query identified in this passage is merely exemplary and that a variety of statements, questions, comments, and the like, may be utilized. If the passerby does have unwanted garbage they may now become a user of the vacuum trash insertion receptacle by placing garbage within.

The VTIR, in step 930, accepts the garbage provided by the user through the trash tube. The trash tube is coupled with the housing and provides the gate through which trash is inserted by the user. The trash tube is further coupled with the vacuum assembly and the trash receptacle assembly. The VTIR includes the gate monitoring assembly, which provides information to the control assembly and is coupled to the vacuum assembly. When the gate monitoring assembly indicates that trash has been inserted through the gate, into the trash tube, the control assembly activates the vacuum assembly, which provides vacuum suction to the trash tube and transports the garbage received through the trash tube and into the trash receptacle assembly.

In the exemplary embodiments, the methods disclosed may be implemented as sets of instructions or software readable by a device. Further, it is understood that the specific order or hierarchy of steps in the methods disclosed are examples of exemplary approaches. Based upon design preferences, it is understood that the specific order or hierarchy of steps in the method can be rearranged while remaining within the scope and spirit of the present invention. The accompanying method claims present elements of the various steps in a sample order, and are not necessarily meant to be limited to the specific order or hierarchy presented.

It is believed that the VTIR of the present invention and many of its attendant advantages will be understood by the forgoing description. It is also believed that it will be apparent that various changes may be made in the form, construction, and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A vacuum trash insertion receptacle assembly, comprising:

a housing including a trash tube, the trash tube being suitable for allowing the insertion of garbage within the vacuum trash insertion receptacle assembly;

a vacuum assembly coupled to the trash tube, the vacuum assembly being suitable for creating a vacuum within the trash tube for transporting the garbage in the trash tube to a trash receptacle assembly;

a gate monitoring assembly communicatively coupled to the vacuum assembly via a control assembly for causing activation of the vacuum assembly when insertion of garbage through a gate of the trash tube is detected;

an indicator assembly coupled to the trash tube for indicating the level of garbage within the trash receptacle assembly; and an interactive module assembly coupled with the housing, the interactive module assembly being suitable for providing interaction with a user, wherein the vacuum trash insertion receptacle assembly provides user interactive garbage collection and storage.

2. The vacuum trash insertion receptacle assembly of claim 1, further comprising a proximity assembly for detecting movement within a defined area immediately surrounding the housing.

3. The vacuum trash insertion receptacle assembly of claim 1, wherein the vacuum trash insertion receptacle is a portable vacuum trash insertion receptacle.

4. The vacuum trash insertion receptacle assembly of claim 1, wherein the interactive module assembly further comprises at least one of an audio module and a video module.

5. The vacuum trash insertion receptacle assembly of claim 1, wherein the indicator assembly is coupled to at least one of the housing and the trash receptacle assembly.

6. The vacuum trash insertion receptacle assembly of claim 1, further comprising an animation assembly.

7. A garbage collection system, comprising:

a housing aesthetically shaped as an animal, including a trash tube suitable for allowing the insertion of garbage within the housing;

a vacuum assembly coupled to the trash tube, the vacuum assembly being suitable for creating a vacuum within the trash tube for transporting the garbage in the trash tube to a trash receptacle assembly;

a gate monitoring assembly communicatively coupled to the vacuum assembly via a control assembly for causing activation of the vacuum assembly when insertion of garbage through a gate of the trash tube is detected;

an indicator assembly coupled to the trash tube for indicating the level of garbage within the trash receptacle assembly;

an interactive module assembly coupled with the housing, the interactive module assembly being suitable for providing interaction with a user; and a proximity assembly coupled to the interactive module assembly, the proximity assembly being suitable for detecting movement within a defined area immediately surrounding the housing, wherein the vacuum trash insertion receptacle assembly provides user interactive garbage collection and storage.

8. The vacuum trash insertion receptacle assembly of claim 7, wherein the interactive module assembly further comprises at least one of an audio module and a video module.

9. The vacuum trash insertion receptacle assembly of claim 7, wherein the indicator assembly is coupled to at least one of the housing and the trash receptacle assembly.

10. The vacuum trash insertion receptacle assembly of claim 7, further comprising an animation assembly.

11. The vacuum trash insertion receptacle assembly of claim 7, wherein the vacuum trash insertion receptacle is a portable vacuum trash insertion receptacle.

12. A method for collecting garbage, comprising:

establishing a vacuum trash insertion receptacle;

identifying a user in need of garbage collection; and collecting garbage from the user, wherein the vacuum trash insertion receptacle comprises:

a housing including a trash tube, the trash tube being suitable for allowing the insertion of garbage within the vacuum trash insertion receptacle assembly;

a vacuum assembly coupled to the trash tube, the vacuum assembly being suitable for creating a vacuum within the trash tube for transporting the garbage in the trash tube to a trash receptacle assembly;

a gate monitoring assembly communicatively coupled to the vacuum assembly via a control assembly for causing activation of the vacuum assembly when insertion of garbage through a gate of the trash tube is detected;

an indicator assembly coupled to the trash tube for indicating the level of garbage within the trash receptacle assembly; and an interactive module assembly coupled with the housing, the interactive module assembly being suitable for providing interaction with a user.

13. The method of claim 12, wherein the interactive module assembly comprises at least one of an audio module and a video module.

14. The method of claim 13, further comprising determining the garbage collection needs of a user by using the interactive module assembly.

15. The method of claim 12, wherein identifying a user is accomplished by a proximity assembly coupled with the interactive module assembly, the proximity assembly being suitable for detecting movement within a defined area immediately surrounding the housing.

16. The method of claim 12, wherein the gate is coupled to a first end of the trash tube.

* * * * *